United States Patent [19]

Krips

[11] 3,977,068

[45] Aug. 31, 1976

[54] DEVICE AND METHOD FOR EXPANSION-SWAGING TUBES INTO THE BORES OF A TUBE PLATE

[75] Inventor: Herbert Krips, Bochum-Langendreer, Germany

[73] Assignee: Balcke-Durr Aktiengesellschaft, Ratingen, Germany

[22] Filed: July 14, 1975

[21] Appl. No.: 595,428

[52] U.S. Cl. ..... 29/421. R; 29/157.4; 29/202. D; 72/62; 113/1. C; 228/155

[51] Int. Cl.[2] ..... B23P 17/00

[58] Field of Search ..... 29/421, 200 B, 202 D, 29/202 R, 157.3 C, 157.4; 72/62, 54; 113/1 C, 118 R; 228/155

[56] References Cited

UNITED STATES PATENTS

| | | | |
|---|---|---|---|
| 1,930,745 | 10/1933 | Fisher | 29/421 X |
| 2,460,580 | 2/1949 | Huber | 29/421 |
| 2,479,702 | 8/1949 | Road | 29/421 X |
| 3,349,465 | 10/1967 | La Pan et al. | 29/157.4 |
| 3,562,887 | 2/1971 | Schroeder et al. | 29/157.4 |
| 3,608,173 | 9/1971 | Watson et al. | 29/157.4 |
| 3,774,291 | 11/1973 | Snyder et al. | 29/157.4 X |

FOREIGN PATENTS OR APPLICATIONS

| | | | |
|---|---|---|---|
| 853,630 | 1/1955 | Germany | 72/54 |
| 932,964 | 11/1960 | United Kingdom | 72/54 |

*Primary Examiner*—Victor A. Dipalma
*Attorney, Agent, or Firm*—Joseph A. Geiger

[57] ABSTRACT

A device and method for the expansion-swaging of tubes into a tube plate where an expansion core is inserted into the tube and two pressure rings on the core axially delimit a radially very narrow pressure space into which a very highly pressurized fluid is introduced, thereby expanding the tube. The pressure rings are of highly pressure resistant material and are supported by abutment shoulders of inner and outer core guide portions engaging the tube with minimal clearance.

11 Claims, 2 Drawing Figures

DEVICE AND METHOD FOR EXPANSION-SWAGING TUBES INTO THE BORES OF A TUBE PLATE

BACKGROUND OF THE INVENTION

1. Field of the Invention

The present invention relates to devices and methods for attaching tubes to the inner walls of receiving bores, and more particularly to devices and methods for swaging tubes into the bores of a tube plate by radially expanding each tube under the action of internal pressure introduced into the tube by means of an expansion core and a highly pressurized hydraulic pressure medium.

2. Description of the Prior Art

Tube anchoring methods and devices of the abovementioned kind are particularly suitable for the expansion-swaging of tube ends into the receiving bores of the tube plates of a heat exchanger, for example. It has been suggested in the past to attach the tubes of a heat exchanger tube cluster to the receiving bores of a tube plate in a swaging operation performed by means of expansion rollers or cores, or in a welding operation, the latter being in some cases combined with a swaging operation.

In recent years, it has further been suggested to utilize the pressure generated by the detonation of an explosive to expansion-swage a hollow body against the inner wall of a receiving bore or cavity. Still another known method of achieving an expansion-swaging effect involves the utilization of ice, where a core is introduced into the end portion of the tube, and the annular space between the core and the tube is filled with pressurized ice water which is then left to solidify. Since the ice water expands as it solidifies, it causes the tube to expand accordingly, thereby producing the desired swaging effect against the bore of the tube plate. A shortcoming of this method, however, is the fact that the degree of expansion and the swaging forces thereby obtainable are restricted to a very narrow range, controlled by the exact volume increase. It is a fact that the maximum pressure which is achievable through the freezing of water inside a closed container is approximately 2000 kp/cm$^2$. For many applications, however, this pressure is still inadequate.

The use of explosives for the purpose of expansion-swaging has the disadvantage that the forces generated cannot be controlled sufficiently well to obtain consistently even deformations and reliably swaged connections.

SUMMARY OF THE INVENTION

It has now been discovered that, contrary to established belief, it is possible to expand a tubular body through the application of high pressure by means of a pressure fluid, so as to create an expansion-swaging effect of controllable proportions, whereby the ends of heat exchanger tubes can be attached to the bores of a tube plate in a gap-free expansion-swaged connection.

It is therefore a primary objective of the present invention to suggest an improved device and method for the expansion-swaging of tubes into the bores of a tube plate with the aid of a pressure fluid under very high pressure.

The present invention proposes to attain this objective by suggesting a device for the expansion-swaging of tubes which includes an expansion core forming an annular pressure space between it and the bore of the tube, the pressure space being axially delimited by axially supported pressure rings of a resilient, highly resistant material whose outer diameter, prior to the insertion of the core, is slightly larger than the inner diameter of the unexpanded tube, a highly pressurized fluid being introduced into the pressure space through a central axial supply bore and a radially communicating bore in the expansion core.

The preferred embodiment of the invention further suggests that the expansion core be provided with core guide portions arranged axially adjacent to the grooves which receive the pressure space delimiting pressure rings, the core guide portions engaging the tube with minimal clearance.

As a further advantageous feature, the invention suggests that the position of the inner pressure ring be chosen just slightly inside of the tube plate, while the outer pressure ring is spaced a distance inwardly from the outer face of the tube plate. The invention still further suggests that the diameter of the expansion core in the area of the annular pressure space be only a small amount smaller than the diameter of its guide portions, and that the inner and outer pressure rings be in the shape of O-rings, of a highly resistant material, such as polyethylene or rubber.

A particular advantage of the present invention is its ability of precisely limiting the length over which the tube is expansion-swaged into the tube plate, through the appropriate positioning of the grooves for the pressure rings on the expansion core. A still further advantage relates to the possibility of positioning the inner pressure ring just slightly beyond the inner face of the tube plate, thereby extending the expansion-swaging to the very end of the receiving bore in the tube plate.

Heretofore, it was believed that the use of a pressure fluid under very high pressures would meet with failure in the seals delimiting the necessary pressure space. Now, however, it was discovered that, inspite of extremely high pressures, reaching as high as 4500 kp/cm$^2$, for example, the pressure fluid can be contained hermetically with an appropriately designed expansion core and special pressure rings. The latter are preferably of a highly resistant commercially available synthetic plastic such as polyethylene. The actual pressure level required for the novel method of expansion-swaging depends on the diameter and on the wall thickness of the tube to be swaged.

A still further advantage of the present invention resides in the possibility of providing one or more slightly widened length portions in the receiving bore, the novel expansion-swaging method being capable of deforming the tube so as to exactly match these widened portions, thereby greatly increasing the resistance of the swaged connection against extrusion of the tube from its receiving bore.

Another advantage relates to the possibility of simultaneously expansion-swaging a number of tubes into adjacently located bores of a tube plate, by providing an expansion-swaging device having multiple expansion cores connected to a common pressure source. This possibility is particularly suited for applications where the receiving bores in the tube plate are so closely spaced that the expansion-swaging of one tube along would tend to deform the surrounding wall portions of the tube plate and the adjacent receiving bores.

BRIEF DESCRIPTION OF THE DRAWING

Further special features and advantages of the invention will become apparent from the description following below, when taken together with the accompanying drawing which illustrates, by way of example, a preferred embodiment of the invention, represented in the various figures as follows.

DESCRIPTION OF THE PREFERRED EMBODIMENT

Figure 1:
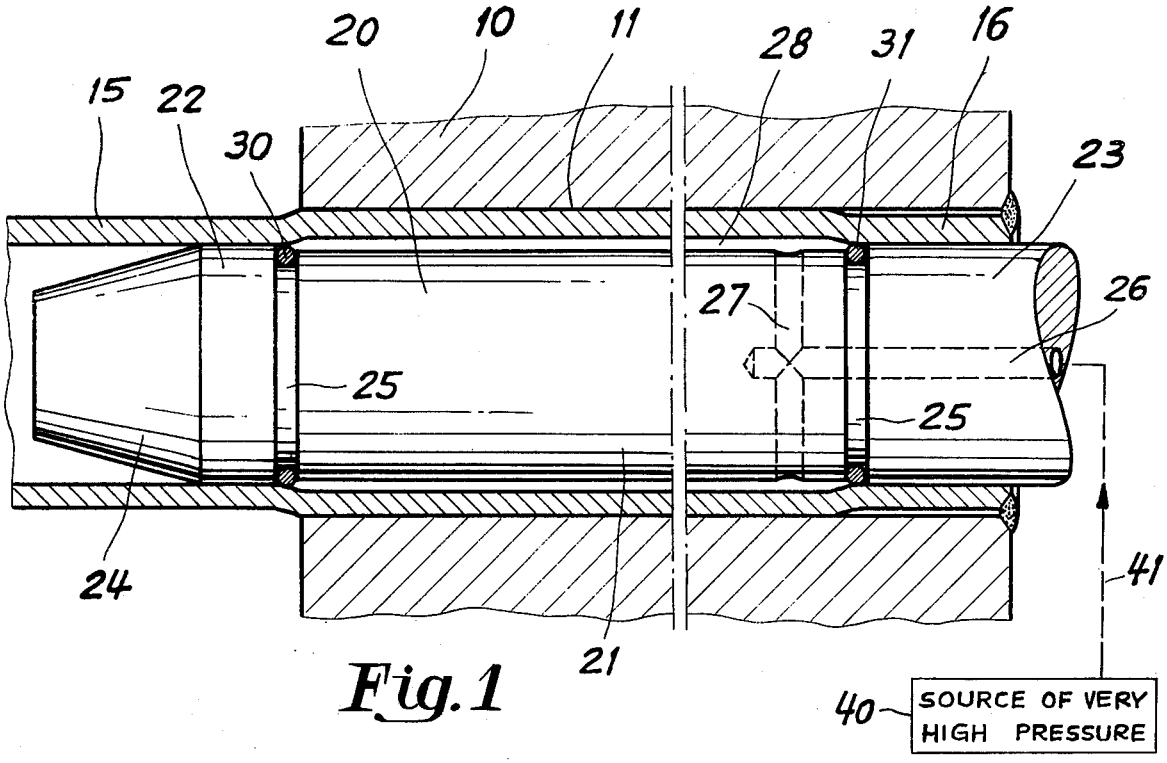
FIG. 1 shows, in a somewhat schematic representation, an expansion-swaging device embodying the invention in operative engagement with a swaged tube.
Figure 2:
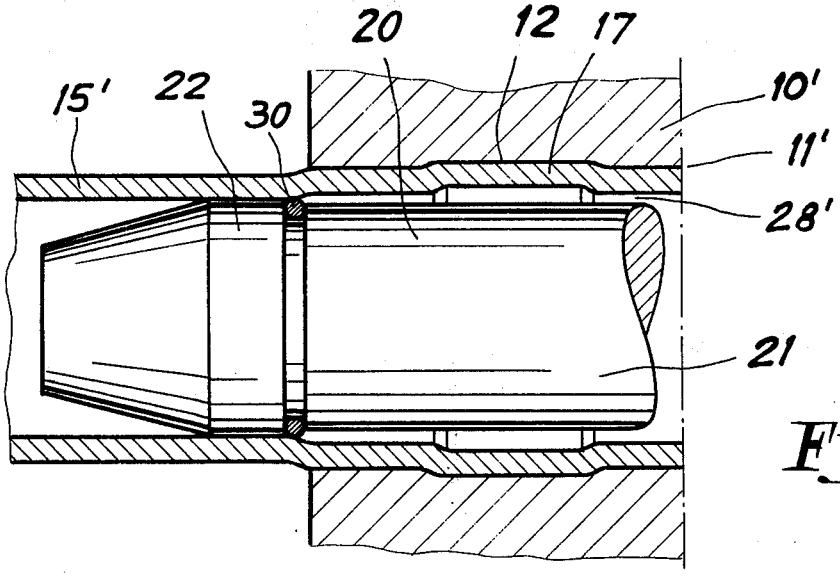
FIG. 2 shows a portion of the arrangement of FIG. 1, representing a modified application of the method of the invention.

Referring to FIG. 1 and FIG. 2 of the drawing, there is shown a tube plate 10 having an anchoring bore 11 arranged therein which, in the case of a heat exchanger, for example, is representative of a large number of similar parallel anchoring bores arranged in the tube plate 10. A tube 15 is shown engaged inside the bore 11, having already been expansion-swaged for a firm connection with the inner wall of the bore 11. It will be noted that, for a better illustration of the comparatively small differences in diameter of the various parts involved in the invention, these differences in diameter have been exaggerated in the illustration given in the drawing.

Prior to the expansion-swaging operation, the tube 15, having an outer diameter somewhat smaller than the diameter of the anchoring bore 11, is inserted into the tube plate 10 from the inner (left-hand) side thereof, to where the leading edge of the tube 15 is flush with the outer face of the tube plate 10. From the outer side is then introduced into the tube 15 an expansion core 20 carrying an inner pressure ring 30 and an outer pressure ring 31 received inside appropriate annular grooves 25 in the body of the expansion core 20. The core 20 is preferably axially so positioned that the inner pressure ring 30 is situated just barely beyond the inner face of the tube plate 10. the outer pressure ring 31 is situated a short distance to the inside of the outer face of the tube plate 10, thereby leaving a tube end portion 16 outside the influence of the annular pressure space 28, as defined between the midportion 21 of the core 20 and the surrounding bore 11 of the tube plate 10.

The particular purpose of positioning the outer pressure ring 31 to the inside of the outer plate face is to prevent the interference with the welded tube extremity of tensions which are created in the transition between the swaged and non-swaged length portions of the tube 15, which is welded to the mouth of the anchoring bore 11 prior to the expansion-swaging operation. The necessity, under certain conditions, to add such a weld connection to the swaging connection is not due to a need for a reinforcement of the connection itself, but serves to provide a hermetic seal between the outer wall of the tube 15 and the anchoring bore 11 for safety reasons and to prevent the penetration of corrosive agents.

The expansion core 20 is extremely simple in design, consisting of a cylindrical midportion 21, bordered by two annular grooves 25 for the inner and outer pressure rings 30 and 31. A short inner core guide portion 22 continues from the inner groove 25, tapering into a core nose 24. A similar, but longer outer core guide portion 23 extends from the outer groove 25 beyond the outer face of the tube plate 10.

Pressure fluid is fed into the pressure space 28 around the core midportion 21, via an axially oriented supply bore 26 and a communicating radial supply bore 27, from a pressure source 40 which is linked to the expansion core 20 by means of a connecting line 41.

The diameter of the midportion 21 of core 20 is only a few tenth of a millimeter smaller than the diameter of the inner and outer core guide portions 22 and 23. The inner and outer pressure rings 30 and 31 are fitted tightly into their respective grooves 25, being mounted in place by stretching them and sliding them over the guide portions of the core 20. In their seated conditions, the pressure rings 30 and 31 have a diameter which is slightly larger than the inner diameter of the non-swaged tube 15.

Following insertion of the expansion core 20 into the tube 15 to the desired axial position, the pressure source 40 is actuated, thereby supplying highly pressurized fluid to the pressure space 28 and expanding that length portion of the tube 15 which surrounds the pressure space 28, until a swaged engagement between the tube 15 and the anchoring bore 11 is obtained. Following this operation, the pressure is relieved, whereupon the expansion core 20 is simply withdrawn from the swaged tube 15.

The method of the present invention has been performed successfully with the following exemplary parameters:

| | |
|---|---|
| Tube: | |
| outer diameter | 22 mm |
| inner diameter | 16.4 mm |
| material | Incoloy 800 |
| Tube plate: | |
| thickness | 300 mm |
| material | 10 Cr Mo 910 |
| Radial width of pressure space | 0.4 mm |
| Swaging pressure | 4500 kp/cm² |

A modified application of the present invention is illustrated in FIG. 2 of the drawing, where a tube 15' is shown swaged into the anchoring bore 11' of a tube plate 10'. Several widened bore portions 12 are arranged in axial succession along the anchoring bore 11', the wall of the tube 15' being forced into the widened bore portions 12 in the course of the swaging operation, thereby greatly increasing the resistance against extrusion of the tube 15' from its anchoring bore 11'.

It should be understood, of course, that the foregoing disclosure describes only a preferred embodiment of the invention and a preferred application of the method of the invention, and that it is intended to cover all changes and modifications of these examples of the invention which fall within the scope of the appended claims.

I claim the following:

1. A device for expansion-swaging a tube against the inner wall of a slightly larger anchoring bore of a tube plate, by forcibly expanding the tube into radial engagement with said wall, under a very high pressure created inside the tube, within a predetermined expansion length portion thereof, the device comprsing in combination:

a unitary expansion core capable of being inserted into the cavity of said tube, said core having several length portions of unequal outer diameter, inlcuding, in succession: an inner core guide portion engaging the tube with minimal insertion clearance; a core midportion of a length corresponding to said expansion length portion and having a diameter which is a small amount smaller than that of the tube cavity, so as to define a radially very narrow pressure space therewith of a radial width just adequate for the pressure fluid to penetrate all areas of the pressure space; and an outer core guide portion likewise engaging the tube with minimal insertion clearance;

a pair of annular grooves between the inner and outer core guide portions and the core midportion, said grooves having radial flanks forming abutment shoulders at the near extremities of the inner and outer core guide portions, said shoulders facing against one another;

a pair of resilient, highly pressure resistant pressure rings seated snugly in said annular grooves of the expansion core, and having an outer diameter which, prior to insertion of the core into the tube cavity, is larger than the latter, said pressure rings thus delimiting and sealing the pressure space in the axial direction;

a high pressure source capable of supplying pressure fluid at a pressure of at least 3000 kp/cm²; and channel means for bringing said pressurized fluid into the pressure space.

2. An expansion-swaging device as defined in claim 1, wherein the channel means includes an axial channel bore leading from the outer end of the expansion core, through the interior of the latter, to the core midportion, and at least one radial channel bore leading from said axial bore to the pressure space surrounding the core midportion.

3. An expansion-swaging device as defined in claim 1, wherein a diameter of the expansion core midportion in relation to the tube bore is such that the radial width of the pressure space is no mroe than 0.5 mm.

4. An expansion-swaging device as defined in claim 1, wherein the pressure rings are so-called O-rings, having a circular cross section.

5. An expansion-swaging device as defined in claim 4, wherein the pressure rings are made of polyethylene.

6. An expansion-swaging device as defined in claim 4, wherein the pressure rings are made of synthetic rubber.

7. An expansion-swaging device as defined in claim 1, further comprising a tapering core nose arranged forward of the inner guide portion of the expansion core and forming that extremity of the expansion core which is first inserted into the tube.

8. A method of expansion-swaging a tube against the inner wall of a slightly larger anchoring bore of a tube plate, for instance the tube plate of a heat exchanger, by forcibly expanding the tube into radial engagement with said wall, the method comprising the steps of:

positioning the tube in the anchoring bore of the tube plate in such a way that one end of the tube is located substantially in alignment with the outer face of the tube plate and the major length portion of the tube extends away from the inner face of the tube plate;

welding the aligned tube end to the outer face of the outer face of the tube plate;

inserting from said end of the tube into the cavity thereof an expansion core cooperating with the tube in such a way that an annular pressure space of predetermined length is formed therebetween;

delimiting the axial length of said pressure space in such a way that its inner axial limit is located a small distance outside the inner face of the tube plate, thereby extending the expansion-swaging effect to a short length portion of the tube immediately outside said tube plate face, and that the outer axial limit of the pressure space is located within the tube plate, at such a distance from the welded tube end that the expansion-swaging deformation taking place in the area of the pressure space is without stress effect on the weld connection;

sealing said axial limits of the pressure space with resilient, highly pressure resistant pressure rings; and introducing into the pressure space a pressure fluid under a pressure of at least 3000 kp/cm².

9. An expansion-swaging method as defined in claim 8, comprising the additional step of undercutting the anchoring bore in the tube plate in such a way that it has at least one widened bore portion located axially within the pressure space, a distance away from both axial limits of the latter.

10. An expansion-swaging method as defined in claim 8, wherein said steps of positioning the tube, of inserting thereinto an expansion core, of delimiting and axially sealing a pressure space, and of introducing into the latter a pressure fluid are performed simultaneously on a plurality of tubes arranged in closely adjacent anchoring bores of a tube plate.

11. An expansion-swaging method as defined in claim 8, wherein said steps are performed with the following parameters:

the tube has an outer diameter of 22 mm, and inner diameter of 16.4 mm, and is made of Incoloy 800;

the tube plate is 300 mm thick and is made of the alloy steel 10 Cr Mo 910;

the radial width of the pressure space is 0.4 mm; and the pressure fluid is pressurized at 4500 kp/cm².

* * * * *